US009232305B2

(12) United States Patent
French et al.

(10) Patent No.: US 9,232,305 B2
(45) **Date of Patent: *Jan. 5, 2016**

(54) ACOUSTIC TRANSDUCER

(75) Inventors: John B. French, Caledon East (CA); Andrew Mason, Bolton (CA)

(73) Assignee: Harman Becker Gepkocsirendszer Gyarto Korlatolt Felelossegu Tarsasag, Szekesfehervar (HU)

( * ) Notice: Subject to any disclaimer, the term of this patent is extended or adjusted under 35 U.S.C. 154(b) by 222 days.

This patent is subject to a terminal disclaimer.

(21) Appl. No.: 13/372,835

(22) Filed: Feb. 14, 2012

(65) Prior Publication Data

US 2012/0257782 A1 Oct. 11, 2012

Related U.S. Application Data

(63) Continuation of application No. 12/239,089, filed on Sep. 26, 2008, now Pat. No. 8,139,816.

(60) Provisional application No. 60/975,339, filed on Sep. 26, 2007.

(51) Int. Cl.

| | |
|---|---|
| ***H04R 1/00*** | (2006.01) |
| ***H04R 3/00*** | (2006.01) |
| ***H04R 9/02*** | (2006.01) |
| ***H04R 9/04*** | (2006.01) |
| ***H04R 9/06*** | (2006.01) |

(52) U.S. Cl.

CPC ..... *H04R 3/00* (2013.01); *H04R 9/025* (2013.01); *H04R 9/04* (2013.01); *H04R 9/06* (2013.01); *H04R 2209/024* (2013.01)

(58) Field of Classification Search

USPC ..... 381/401, 406, 409, 394

See application file for complete search history.

(56) References Cited

U.S. PATENT DOCUMENTS

| | | | | |
|---|---|---|---|---|
| 2,286,123 | A | | 6/1942 | Steers |
| 2,770,681 | A | * | 11/1956 | Perry ..... 381/406 |
| 4,151,379 | A | | 4/1979 | Ashworth |
| 4,243,839 | A | | 1/1981 | Takahashi et al. |

(Continued)

FOREIGN PATENT DOCUMENTS

| | | | |
|---|---|---|---|
| CN | 1046079 | A | 10/1990 |
| CN | 1554210 | A | 12/2004 |

(Continued)

OTHER PUBLICATIONS

Machine translation from TotalPatent of CN 1046079.

(Continued)

*Primary Examiner* — Curtis Kuntz
*Assistant Examiner* — Ryan Robinson
(74) *Attorney, Agent, or Firm* — Brooks Kushman P.C.

(57) ABSTRACT

This invention relates to acoustic drivers with stationary and moving coils. Time varying signals are applied to the moving and stationary coils to control the movement of a diaphragm, which produces audible sound. The time varying signals correspond to an input audio signal such that the sound corresponds to the input audio signal. Some of the described embodiments include multiple moving coils, multiple stationary coils or both. Some embodiments include feedback for adjusting one or more of the signals based on a characteristic of the acoustic driver. Various compensation and other features of the invention are also described in relation to various embodiments.

19 Claims, 15 Drawing Sheets

(56) References Cited

U.S. PATENT DOCUMENTS

| | | | | |
|---|---|---|---|---|
| 4,531,025 | A | 7/1985 | Danley et al. | |
| 4,607,382 | A | 8/1986 | Dijkstra et al. | |
| 4,722,517 | A | 2/1988 | Dijkstra et al. | |
| 5,487,114 | A * | 1/1996 | Dinh | 381/406 |
| 5,832,096 | A * | 11/1998 | Hall | 381/400 |
| 5,912,978 | A | 6/1999 | Eastty et al. | |
| 6,208,742 | B1 * | 3/2001 | Garcia et al. | 381/401 |
| 6,243,472 | B1 | 6/2001 | Bilan et al. | |
| 6,259,935 | B1 | 7/2001 | Saiki et al. | |
| 6,639,994 | B1 | 10/2003 | Proni | |
| 7,197,155 | B2 | 3/2007 | Bank | |
| 2004/0042631 | A1 | 3/2004 | Amino | |
| 2005/0031140 | A1 | 2/2005 | Browning | |
| 2005/0031151 | A1 | 2/2005 | Melillo | |
| 2006/0067553 | A1 | 3/2006 | Manrique | |
| 2006/0165251 | A1 | 7/2006 | Bank | |

FOREIGN PATENT DOCUMENTS

| | | | |
|---|---|---|---|
| DE | 3445572 | A1 | 6/1985 |
| EP | 0810810 | A2 | 12/1997 |
| WO | 94/16536 | A1 | 7/1994 |
| WO | 03024151 | A1 | 3/2003 |

OTHER PUBLICATIONS

Wolfe, "Electric Motors and Generators", Physclips, The University of New South Whales, School of Physics, Sydney, Australia.
Douglas et al., "The Dual Coil Loudspeaker", JBL Professional, Northridge, U.S.A.
Robineau et al., "Current Controlled Vented Box Loudspeaker System with Motional Feedback", Laboratory of Electromagnetism and Acoustics, Federal Institute of Technology, Lausanne, Switzerland.
Klippel, "Nonlinear Adaptive Controller for Loudspeakers with Current Sensor", Klippel GmbH, Dresden, Germany.
Croft, "Acoustic Patents" DFS Sales, Inc. Westmont, Illinois.
1st Office Action with English Translation issued in CN Application No. 200880117082.0 (date of issue Oct. 9, 2012).
Response to 1st Office Action (date of issue Oct. 9, 2012) filed Apr. 17, 2013 (in CN Application No. 200880117082.0).
2nd Office Action with English Translation issued in CN Application No. 200880117082.0 (date of issue May 23, 2013).
Response to 2nd Office Action (date of issue May 23, 2013) filed Sep. 25, 2013 (in CN Application No. 200880117082.0).
EP Communication pursuant to Article 94(3) EPC in EP Application No. 08832848.9 (date of issue Dec. 18, 2013).
International Preliminary Report and Written Opinion in International Application No. PCT/CA2008/001703 (date of issue Mar. 30, 2010).
Decision of Rejection issued in CN Application No. 200880117082.0 (date of issue Jan. 15, 2014).
Machine translation for CN1046079A, Oct. 10, 1990, 3 pages.
Croft, "Acoustic Patents", DFS Sales, Inc., Westmont, IL, Sep. 2001, 2 pages.
Klippel, "Nonlinear Adaptive Controller for Loudspeakers", AES 106th Convention, Munich, Germany, May 8-11, 1999, 19 pages.
Robineau et al., "Current controlled vented box loudspeaker system with motional feedback", AES 108th Convention, Paris, Feb. 19-22, 2000, 15 pages.
Wolfe, "Electric motors and generators", Physclips, The University of New South Wales, Sydney, Australia, Jul. 7, 2009, 13 pages.
Button et al, "The Dual Coil Drive Loudspeaker", JBL Professional, Northridge, USA, Microphones & Loudspeakers, AES UK Conference, Mar. 1, 1998, pp. 89-105.
Mowry, "Steallus, Part 1", Voice Coil, The Periodical for the Loudspeaker Industry, www.audioXpress.com, Jan. 1, 2007, 4 pages.
Mowry, "Steallus Part 1", Voice Coil The Periodical for the Loudspeaker Industry, 2007.
Hoffman (n.d.), "Speaker clank" and the "physical" sound, Amptone.com, Retrieved Apr. 30, 2002, from http://www.amptone.com/g118.htm.
Mills et al., "Distortion Reduction in Moving-Coil Loudspeaker Systems Using Current-Drive Technology", J. Audio Eng. Soc., vol. 37, No. 3, Mar. 1989.
Parker, "Trends in Loudspeaker Magnet Structures", Journal of the Audio Engineering Society, vol. 12., No. 3, Jul. 1964.
Hart (n.d.), Loudspeaker Equipment, The American Widescreen Museum, Retrieved Apr. 30, 2002, from http://www.widescreenmuseum.com/sound/RCA11-02.htm.
Extended European Search Report, issued on Dec. 8, 2011, in European Patent Application No. 08832848.9.

* cited by examiner

ACOUSTIC TRANSDUCER

CROSS-REFERENCE TO PRIOR APPLICATIONS

This application is a continuation of U.S. patent application Ser. No. 12/239,089, filed on Sep. 26, 2008, which is now U.S. Pat. No. 8,139,816; and which in turn claims the benefit of U.S. provisional patent application No. 60/975,339, filed on Sep. 26, 2007 the disclosures of which are hereby incorporated by reference in their entirety.

FIELD

The embodiments described herein relate to acoustic transducers.

BACKGROUND

Many acoustic transducers or drivers use a moving coil dynamic driver to generate sound waves. In most transducer designs, a magnet provides a magnetic flux path with an air gap. The moving coil reacts with magnetic flux in the air gap to move the driver. Initially, an electromagnet was used to create a fixed magnetic flux path. These electromagnet based drivers suffered from high power consumption and loss. More recently, acoustic drivers have been made with permanent magnets. While permanent magnets do not consume power, they have limited BH products, can be bulky and depending on the magnetic material, they can be expensive. In contrast the electromagnet based drivers do not suffer from the same BH product limitations.

There is a need for a more efficient electromagnet based acoustic transducer that incorporates the advantages of electromagnets while reducing the effect of some of their disadvantages.

SUMMARY

In one aspect, the present invention provides a method of operating an acoustic transducer. The method comprises: receiving an input audio signal; generating a time-varying stationary coil signal in a stationary coil, wherein the stationary coil signal corresponds to the input audio signal and wherein the stationary coil induces magnetic flux in a magnetic flux path; generating a time-varying moving coil signal in a moving coil, wherein: the moving coil is disposed within the magnetic flux path; the moving coil signal corresponds to both the stationary coil signal and the input audio signal; and the moving coils are coupled to a moving diaphragm which moves in response to the moving coil signal and the stationary coil signal.

In another aspect the invention provides a method of operating an acoustic transducer, the method comprising: receiving an input audio signal; generating a time-varying stationary coil signal in each of one or more stationary coils, wherein each of the stationary coil signals corresponds to the input audio signal and wherein each of the stationary coils induces magnetic flux in a corresponding magnetic flux path; generating a time-varying moving coil signal in each of one or more moving coils, wherein: each of the moving coils is disposed within at least one of the magnetic paths; each of the moving coil signals corresponds to one or more of the stationary coil signals and the input audio signal; and the moving coils are coupled to a moving diaphragm which moves in response to the moving coil signals and the stationary coil signals.

Another aspect of the invention provides an acoustic transducer comprising: an audio input terminal for receiving an input audio signal; one or more stationary coils for inducing a magnetic flux path; one or more moving coils coupled to a moving diaphragm, wherein the moving coils are disposed at least partially within the magnetic flux path; a control system coupled to the input terminal and adapted to produce a time-varying stationary coil signal in at least one of the stationary coils and to produce a time-varying moving coil signal in each of the moving coils, and wherein all of the stationary coil signals and the moving coil signal are dependent on the input audio signal, and wherein the movement of the diaphragm in response to the stationary coil signals and the moving coil sign also corresponds to the input audio signal.

Another aspect of the invention provides an acoustic transducer comprising: an audio input terminal for receiving an input audio signal; a driver having: a moving diaphragm; a magnetic material having an air gap; a stationary coil for inducing magnetic flux in the magnetic material and the air gap; a moving coil coupled to the diaphragm wherein the moving coil is disposed at least partially within the air gap; and a control system for: producing a time-varying stationary coil signal in the stationary coil, wherein the stationary coil signal corresponds to the audio input signal; and producing a time-varying moving coil signal in the moving coil, wherein the moving coil signal corresponds to the audio input signal and the stationary coil signal.

Various embodiments according to each of the aspects provide additional elements and features.

In some embodiments, the stationary coil signal or signals may be generated corresponding to a square root of the audio input signal. In some embodiments, the moving coil signal or signals may also correspond to the square root of the audio input signals.

In some embodiments, the moving coil signal or signals are generated in response to both the input audio signal and the stationary coil signal or signals.

In some embodiments, the stationary coil signal or signals may be unidirectional signals such that the magnetic flux generated in the magnetic flux path flows in a single direction while the moving coil signal or signals are bidirectional. In other embodiments, the moving coil signal or signals are unidirectional while the stationary coil signal or signals are bidirectional.

In some embodiments, the stationary coil signal or signals are maintained above a minimum signal level to ensure that a minimum level of magnetic flux is flowing in one or more of the magnetic flux paths. In some embodiments, the minimum level is only maintained if the moving coil signal exceeds a threshold.

In some embodiments, the stationary coil signal corresponds to a rectified version of the input audio signal.

Some embodiments include a bucking coil in series with the moving coil and wound with a polarity opposing the polarity of the moving coil. In some embodiments, the bucking coil is mounted to a stationary component of the acoustic transducer.

In some embodiments, the stationary coil signals is/are generated at one a plurality of selected signal levels.

In some embodiments, the stationary coil signal is compensated based on a characteristic of the magnetic material. In some embodiments, the characteristic is a saturation characteristic of the magnetic material. In some embodiments, the characteristic is remanent magnetization of the magnetic material.

In some embodiments, the moving coil signal is adjusted based on a characteristic of the magnetic material. In some embodiments, the acoustic transducer includes a driver. A characteristic of the driver is sensed and the moving coil signal is adjusted in response to the sensed characteristic.

Additional features of various aspects and embodiments are described below.

BRIEF DESCRIPTION OF THE DRAWINGS

Several embodiments of the present invention will now be described in detail with reference to the drawings, in which.

Various features of the drawings are not drawn to scale in order to illustrate various aspects of the embodiments described below. In the drawings, corresponding elements are, in general, identified with similar or corresponding reference numerals.

DETAILED DESCRIPTION OF EXEMPLARY EMBODIMENTS

Figure 1:
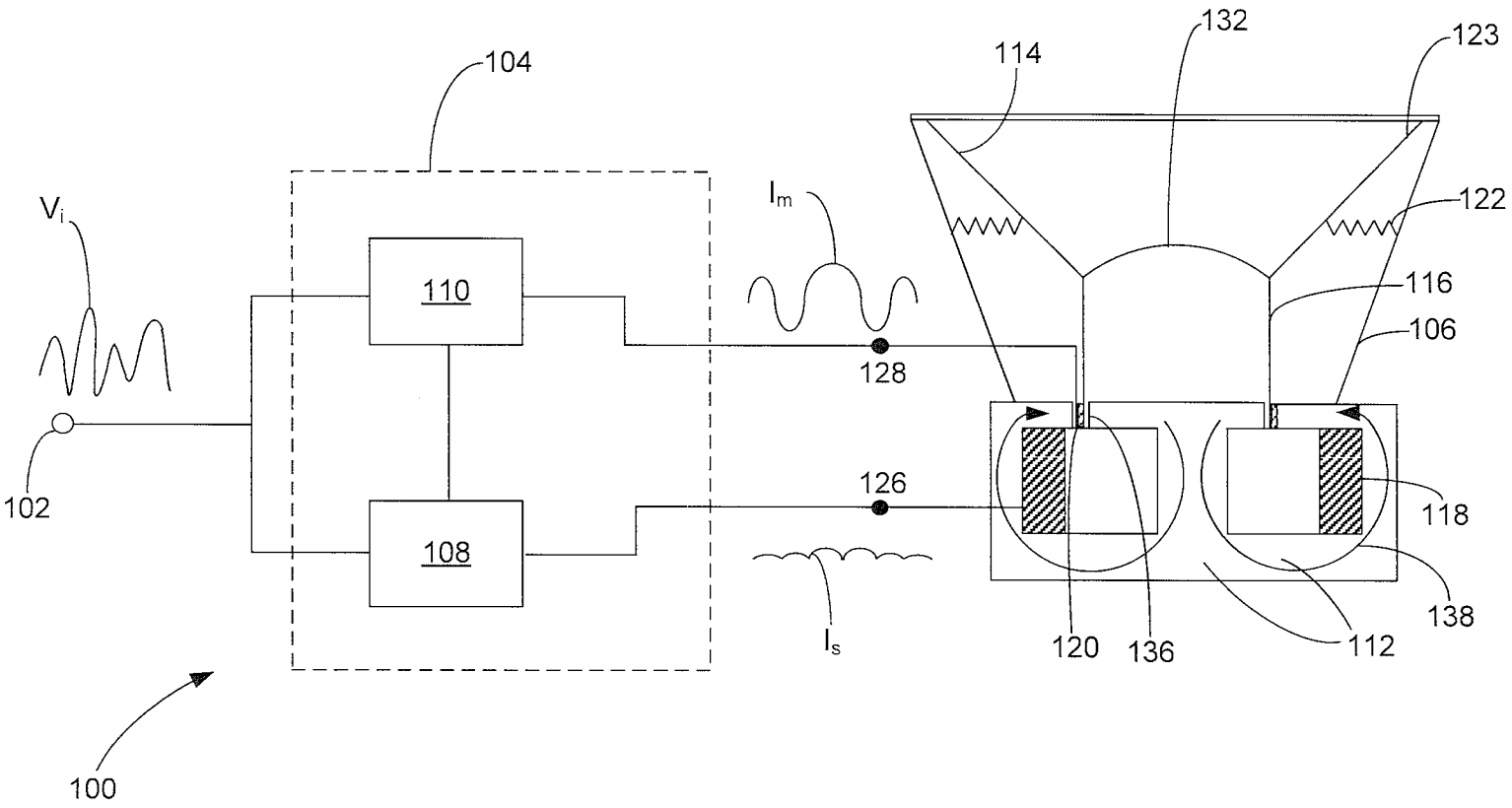
FIGS. 1-3 illustrates an embodiment of an acoustic transducer according to the invention.
Figure 2:
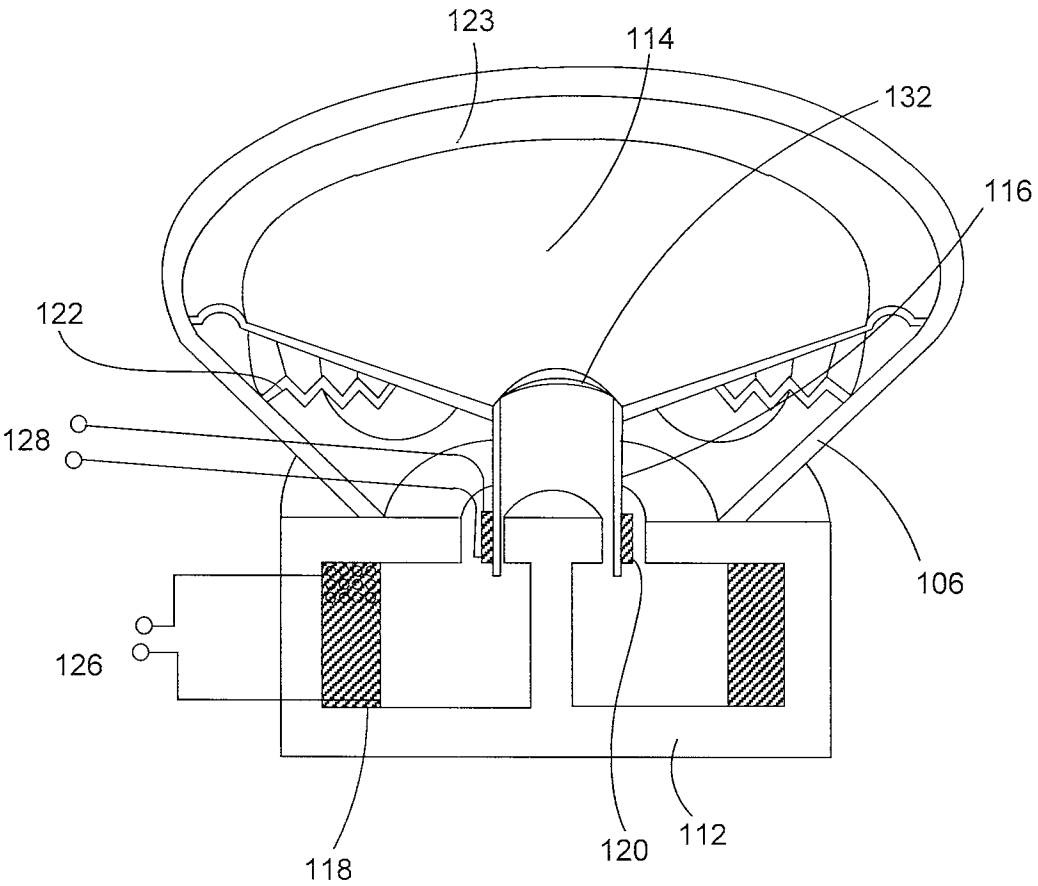

Reference is first made to FIG. 1, which illustrates an acoustic transducer 100 according to some embodiments of the present invention. Transducer 100 has an input terminal 102, a control block 104, and a driver 106. FIG. 1 illustrates driver 106 in cross-section and the remaining parts of transducer 100 in block diagram form.

Control block 104 includes a stationary coil signal generation block 108 and a moving coil signal generation block 110. Each of the stationary and moving coil signal generation blocks is coupled to the input terminal 102. In operation, an input audio signal $V_i$ is received at input terminal 102, and is transmitted to both the stationary coil signal generation block 108 and the moving coil generation block 110. Stationary coil signal generation block 108 generates a stationary coil signal $I_s$ at node 126 in response to the input signal $V_i$. Similarly, the moving coil signal generation block 110 generates a moving coil signal $I_m$ at node 128 in response to the input signal $V_i$.

Driver 106 includes magnetic material 112, a diaphragm 114, a moving coil former 116, a stationary coil 118 and a moving coil 120. Driver 106 also includes an optional diaphragm support or spider 122 and a surround 123.

Magnetic material 112 is generally toroidal and has a toroidal cavity. Stationary coil 118 is positioned within the cavity. In various embodiments, magnetic material 112 may be formed from one or more parts, which may allow stationary coil 118 to be inserted or formed within the cavity more easily. Magnetic material 112 is magnetized in response to the stationary coil signal, producing magnetic flux in the magnetic material. Magnetic material has a toroidal air gap 136 in its magnetic circuit 138 and magnetic flux flows through and near the air gap 136.

Magnetic material 112 may be formed of any material that is capable of becoming magnetized in the presence of a magnetic field. In various embodiments, magnetic material 112 may be formed from two or more such materials. In some embodiments, the magnetic material may be formed from laminations. In some embodiments, the laminations may be assembled radially and may be wedge shaped so that the composite magnetic material is formed with no gaps between laminations.

Moving coil 120 is mounted on moving coil former 116. Moving coil 120 is coupled to moving coil signal generation block 110 and receives the moving coil signal $I_m$. Diaphragm 114 is mounted to moving coil former 116 such that diaphragm 114 moves together with moving coil 120 and moving coil former 116. The moving coil 120 and moving coil former 116 move within air gap 136 in response to the moving coil signal $I_m$ and the flux in the air gap. Components of acoustic transducer that move with the moving coil former may be referred to as moving components. Components that are stationary when the moving coil former is in motion may be referred to as stationary components. Stationary components of the acoustic transducer include magnetic material 112 and the stationary coil 118.

In various embodiments, the acoustic transducer may be adapted to vent the air space between the dust cap 132 and magnetic material 112. For example, a aperture may be formed in the magnetic material, or apertures may be formed in the moving coil former to allow vent the air space, thereby reducing or preventing air pressure from affecting the movement of the diaphragm.

Control block 104 generates the stationary and moving coil signals in response to the input signal $V_i$ such that diaphragm 114 generates audio waves corresponding to the input signal $V_i$.

The stationary and moving coil signals correspond to the input signal and also correspond to one another. Both of the signals are time-varying signals, in that the magnitude of the signals is not fixed at a single magnitude during operation of the acoustic transducer. Changes in the stationary coil signal $I_s$ produce different levels of magnetic flux in the magnetic material 112 and the air gap 136. Changes in the moving coil signal $I_m$ cause movement of the diaphragm 114, producing sound corresponding to the input audio signal $V_i$. In this embodiment, the stationary and moving coil signal generation blocks are coupled to one another. The stationary coil signal $I_s$, or a version of the stationary coil signal, is provided to the moving coil signal generation block 110. The moving coil signal generation block 110 is adapted to generate the moving coil signal $I_m$ partially in response to the stationary coil signal $I_s$ as well as the input signal $V_i$.

In other embodiments, the stationary coil signal may be generated in response to the moving coil signal and input signal. In some other embodiments, the moving and stationary coil signal generation blocks may not be coupled to one another, but one or both of the blocks may be adapted to estimate or model the coil signal generated by the other block and then generate its own respective coil signal in response to the modeled coil signal and the input signal.

Figure 3:
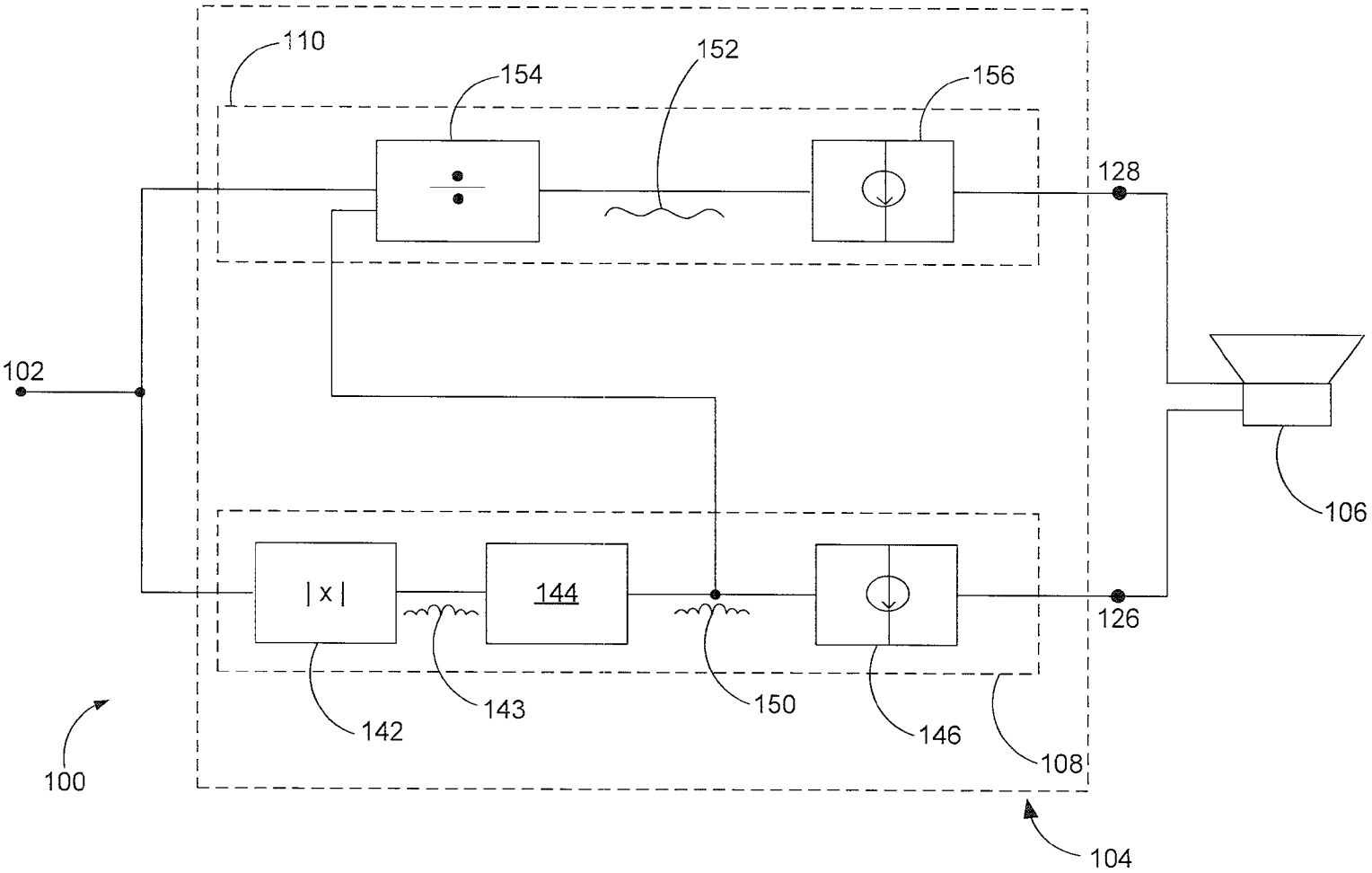

Reference is next made to FIG. 3, which illustrates control block 104 in greater detail.

Stationary coil signal block 108 includes an absolute value block 142, a stationary coil processing block 144 and a stationary coil current regulator 146. Absolute value block 142 receives the input signal $V_i$ and provides a rectified input signal 143. Stationary coil processing block 144 generates a stationary coil control signal 150 in response to the rectified input signal 143. In different embodiments, stationary coil processing block 144 may have various elements and may operate in various manners. Some examples of a stationary coil processing block 144 are described below. Current regulator 146 generates the stationary coil signal $I_s$ as a current signal in response to the stationary coil control signal 150.

Moving coil signal generation block 110 includes a divider 154 and a moving coil current regulator 156. Divider 154 divides the input signal $V_i$ by the stationary coil control signal 150 to generate a moving coil control signal 152. Current regulator 156 generates the moving coil signal $I_m$ as a current signal in response to the stationary coil control signal 150.

In some embodiments, divider 154 may divide a version of the input signal $V_i$ by a version of the stationary coil control signal 150 to generate the moving coil control signal 152. For example, an amplifier or other processing block may be coupled between the input terminal 102 and the moving coil signal generation block 110 and may process the input audio signal $V_i$ to provide a modified version of the input audio signal. The original version of the input audio signal and any such modified version of the input audio signal may be referred to as a version of the audio input signal. Similarly, an element may be coupled to the stationary coil signal generation block 108 to provide a modified version of the stationary coil control signal 150. The original stationary coil control signal or any such modified version of the stationary coil control signal may be referred to as a version of the stationary coil control signal.

In some embodiments, an optional scaler may be inserted between the input terminal 102 and divider 154. In such embodiments, the scaler would provide a scaled version of the input signal. Divider 154 would divide the scaled input signal by the stationary coil control signal 150 to generate a moving coil control signal.

Returning to the present embodiment, the stationary coil signal $I_s$ and moving coil signal $I_m$ are generated as current signals. Diaphragm 114 changes positions (in fixed relation to the movement of the moving coil 120) in relation to the moving and stationary coil signals. At any point in time, the magnetic flux in air gap 136 will be generally proportional to the stationary coil signal (assuming that the stationary coil signal magnitude is not changing too rapidly). Assuming that the stationary coil signal is constant, the diaphragm 114 will move in proportion to changes in the moving coil signal and will produce a specific audio output. If the stationary coil signal $I_s$ is time-varying, the moving coil signal $I_m$ must be modified to accommodate for variations in the magnetic flux in the flux gap 136 in order to produce the same audio output.

In other embodiments, the current regulators 146 and 156 may be replaced with voltage regulators that provide the stationary and moving coil signals as voltage signals in response to the stationary and moving coil control signals. In such embodiments, the stationary and moving coil voltage signals would be derived to generate appropriate currents in the coils.

In various embodiments of acoustic transducers according to the present invention, the stationary and moving coil block may be adapted to operate in various manners depending on the desired performance and operation for the transducer.

Is illustrated in FIG. 3, the moving coil signal $I_m$ may be calculated as follows:

$$I_m = \frac{V_i}{I_s}. \tag{1}$$

Each of the stationary and moving coils has a resistance that causes losses in the stationary and moving coil signals. In some embodiments, it may be desirable to reduce the total losses in the coils. In this case, the losses in each coil should be about equal:

$$I_s^2 R_s = I_m^2 R_m, \tag{2}$$

where: $R_s$ is the resistance of the stationary coil; and $R_m$ is the resistance of the moving coil.

Combining equations (1) and (2) allows the stationary coil signal to be calculated:

$$I_s = \sqrt{|V_i|\sqrt{\frac{R_m}{R_s}}}. \tag{3}$$

The absolute value of input signal $V_i$ is used to calculate the stationary coil signal $I_s$, as illustrated in FIG. 3, allowing the outer square root to be calculated. The moving coil signal may be calculated using equation (1).

$R_m$ and $R_s$ will typically be dependent on the temperatures of the stationary and moving coils. In some embodiments, the temperatures may be measured or estimated and resistances corresponding to the measured or estimated temperatures may be used to calculate $I_s$ and $I_m$.

Using the absolute value of the input signal $V_i$ in equation (3) results in the stationary coil signal being a unidirectional signal. In this embodiment, the stationary coil signal is always a positive signal. The voice coil current is a bidirectional signal and its sign depends on the sign of the input signal $V_i$.

In practice, the useful magnitude of the stationary coil current $I_s$ is limited. The magnetic material 112 has a saturation flux density that corresponds to a maximum useful magnitude for the stationary coil signal $I_s$. Any increase in the magnitude of the stationary coil signal $I_s$ beyond this level will not significantly increase the flux density in the air gap 136. The maximum useful magnitude for the stationary coil signal $I_s$ may be referred to as $I_{s\text{-}max}$.

Figure 4:
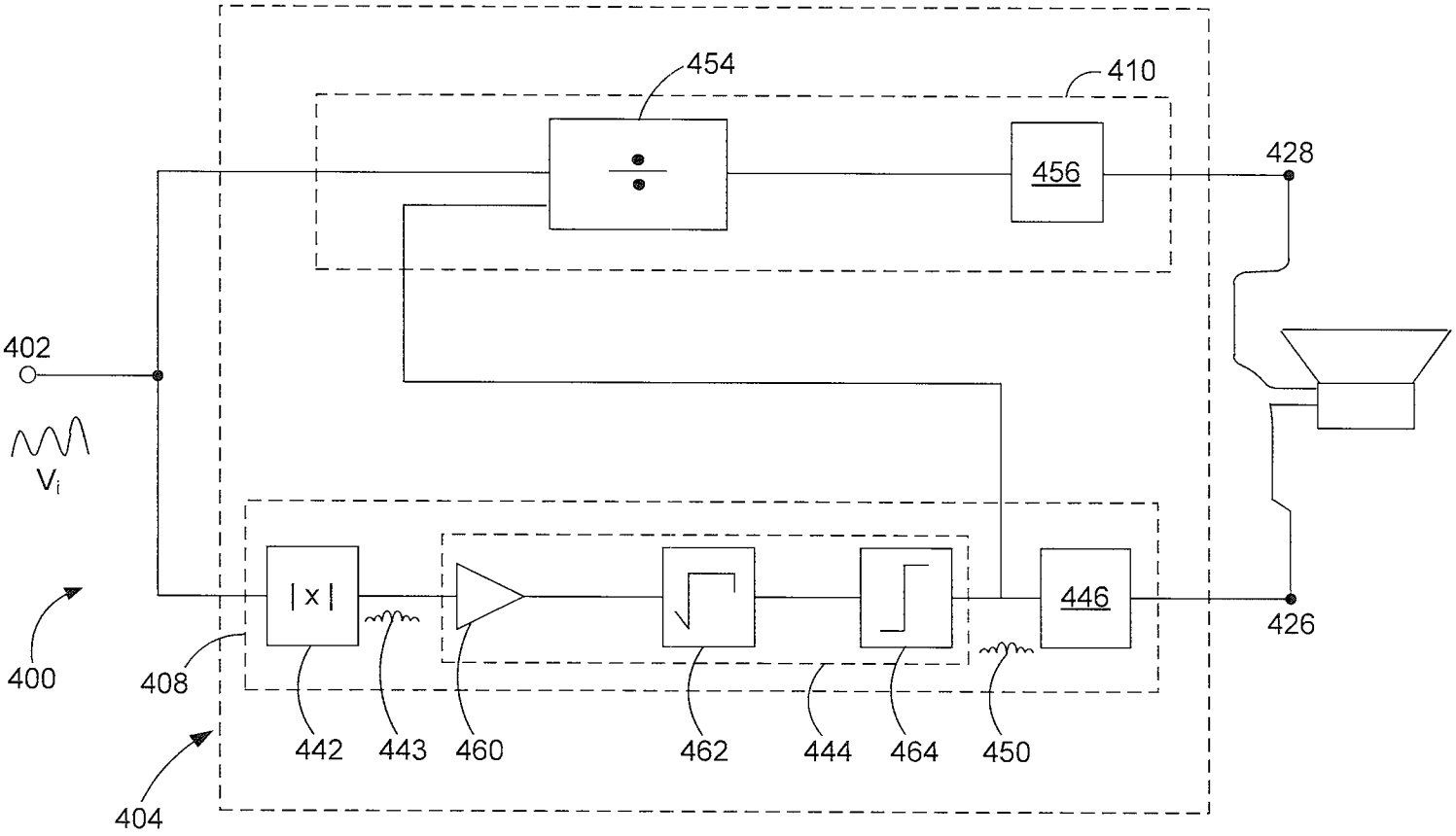
FIGS. 4, 6-13 and 15-16 illustrate other embodiments of acoustic transducers according to the invention.

FIG. 4 illustrates an embodiment that implements equations (1) to (3) in the stationary and moving coil signal generation blocks. Stationary coil signal generation block 408 includes a scaler 460, a square root block 462 and a limiter block 464. Scaler 460 receives a rectified input signal 443 from absolute value block 442. In this embodiment, scaler 460 multiplies the rectified input signal 443 by a constant about equal to $$\frac{R_m}{R_s}$$

to produce a scaled rectified input signal. Square root block 462 takes the square root of the scaled rectified input signal to provide a square root scaled rectified input signal. The limiter block 464 receives the square root scaled rectified input signal and generates a corresponding stationary coil control signal 450. When the square root scaled rectified input signal is smaller than a selected threshold value $V_{464\text{-}max}$, the stationary coil control signal 450 is equal to the square root scaled rectified input signal. At other times, the stationary coil control signal 450 is equal to the threshold value $V_{464\text{-}max}$. In this embodiment, the threshold value $V_{464\text{-}max}$ corresponds to the maximum useful magnitude for the stationary coil signal $I_{s\text{-}max}$.

Figure 5:
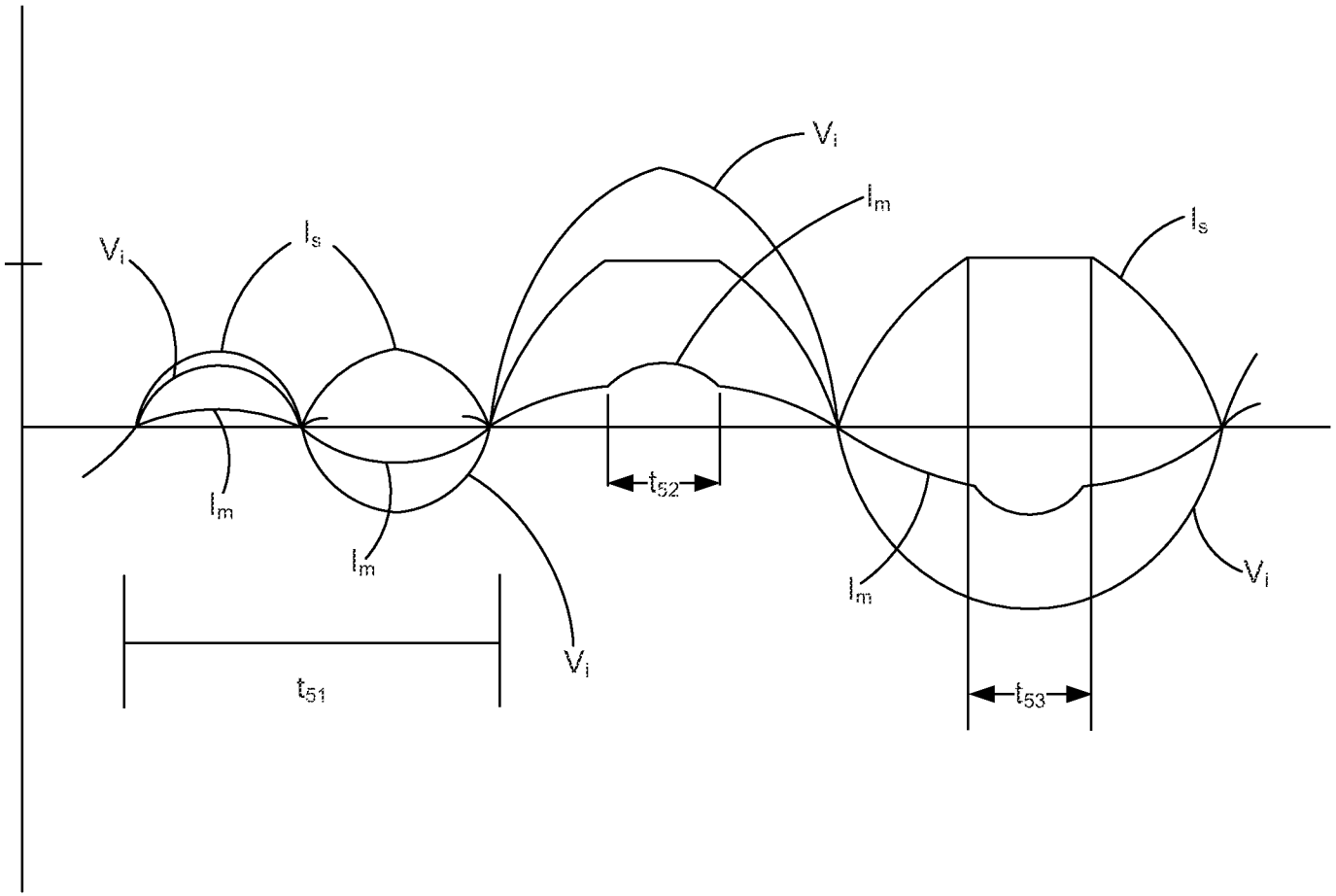
FIG. 5 illustrates some signals in the embodiment of FIG. 4.

The operation of control block 404 is illustrated in FIG. 5, which illustrates the input signal $V_i$, the stationary coil signal $I_s$ and moving coil signal $I_m$. The input signal $V_i$ is received from an external signal source. During time period $t_{51}$, the stationary coil signal $I_s$ varies in proportion with the input signal $V_i$. The moving coil signal varies based on both the stationary coil signal $I_s$ and the input signal $V_i$.

During time periods $t_{52}$ and $t_{53}$, the magnitude of the input signal is sufficiently high that the stationary coil signal is limited by limiter block 464 to its maximum useful magnitude $I_{s\text{-}max}$. The moving coil signal $I_m$ becomes proportional to the input signal $V_i$.

In this embodiment, the limiter block 464 is described as limiting the stationary coil control signal so that the stationary coil signal $I_s$ is limited to its maximum useful magnitude $I_{s\text{-}max}$. In other embodiments, the limiter block 464 may be configured to limit to the stationary coil signal $I_s$ to any selected level. For example, the stationary coil signal may be limited to a selected level to reduce power consumption in the acoustic transducer, or based on characteristics of the stationary coil or the magnetic material in the particular embodiment.

Figure 6:
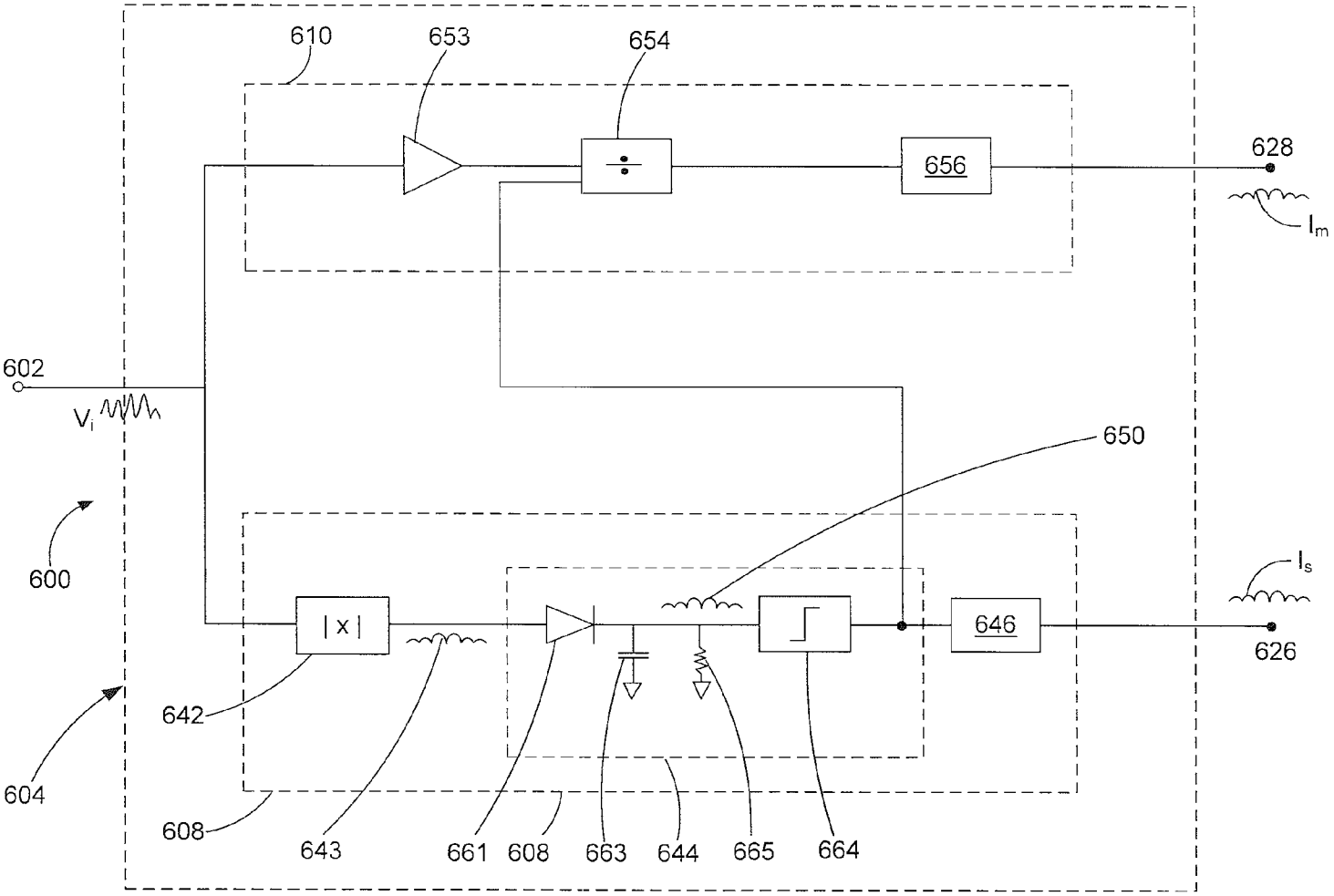

Reference is next made to FIG. 6, which illustrates another embodiment of a stationary coil processing block 644. Stationary coil processing block 644 includes a RCD peak-hold with decay network comprising diode 661 and capacitor 663 and resistor 665. The RCD network detects the peak levels of the rectified input signal 643. Capacitor 663 charges to the peak level and then discharges through resistor 665 until the next peak higher than the voltage across capacitor 663. The resulting stationary coil control signal 650 corresponds to the envelope of the rectified input signal. This embodiment may be used with a stationary coil and magnetic material that may not be sufficiently responsive to a stationary coil signal to allow the magnetic flux in the magnetic material and air gap to change rapidly in response to a higher frequency stationary coil signal.

Figure 7:
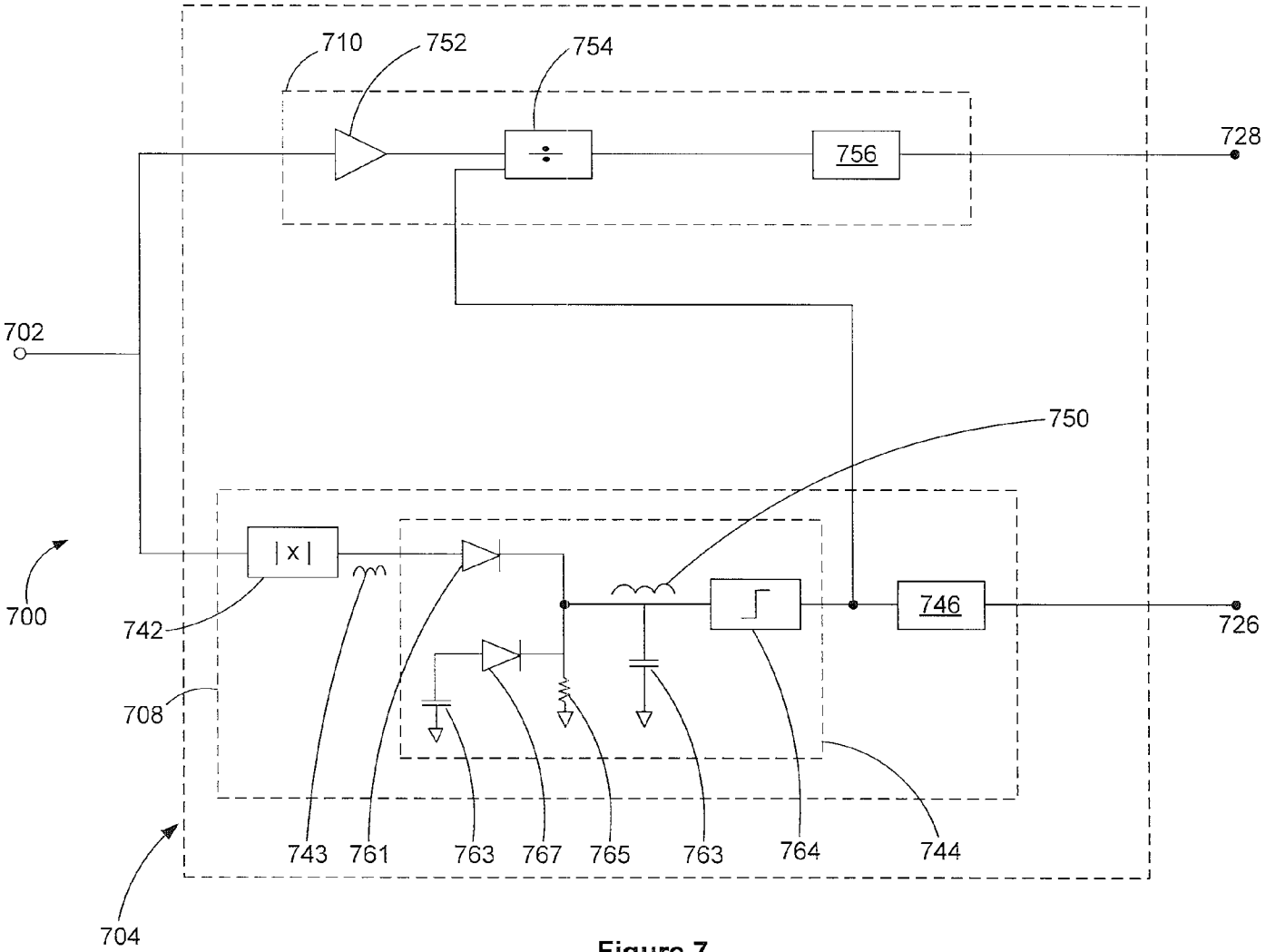

Reference is next made to FIG. 7, which illustrates another stationary coil processing block 744. Stationary coil processing block 744 has a fixed voltage source, which is coupled to limiter block 764 through a diode 767. Absolute value block 742 is coupled to limiter block 764 through a diode 761. The rectified input signal 743 provided by absolute value block 742 and the voltage of the fixed voltage source are diode-or'd by diodes 761 and 767 so that the higher magnitude of the two signals (minus the voltage dropped across the respective diode) is coupled to capacitor 763. Capacitor 763 charges to the higher of the two signals, and discharges through resistor 765, effectively operating as a peak detector with a minimum level corresponding to the magnitude of the voltage source. The voltage across capacitor 763 is coupled to the limiter block 764. The stationary coil generates a stationary coil control signal 750 corresponding to the higher of rectified input signal or the voltage of the voltage source. This ensures that the stationary coil signal does not fall below a minimum level corresponding to the voltage of the voltage source, thereby ensuring that the magnetic material (not shown in FIG. 7) is always magnetized to a level corresponding to that minimum level. The minimum level may be selected to maintain a minimum performance efficiency when the input signal level has a relatively low magnitude.

In another embodiment capacitor 763 may be omitted. In such an embodiment, the stationary coil signal $I_s$ would follow the rectified input signal more precisely.

Figure 8:
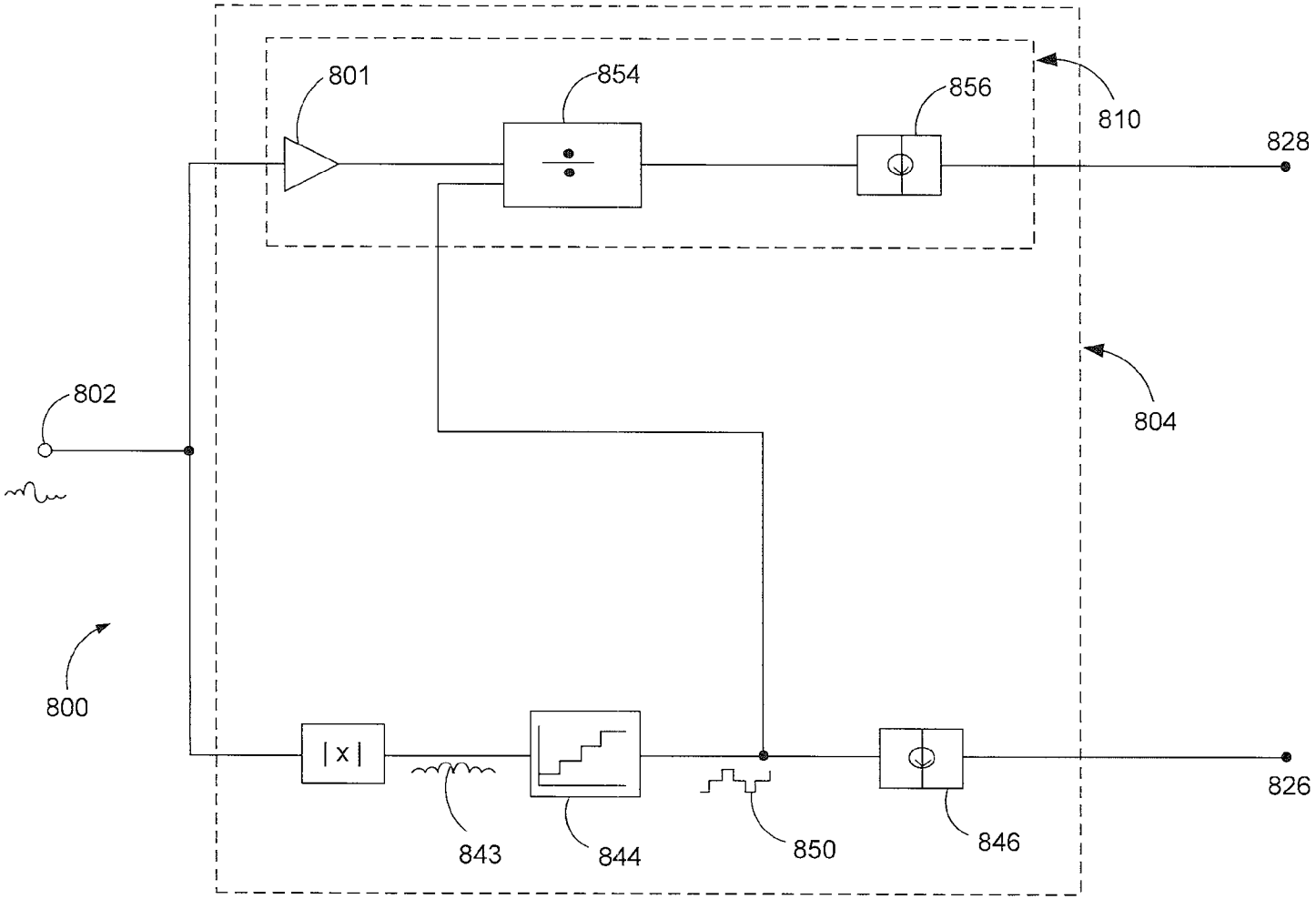

Reference is next made to FIG. 8, which illustrates an acoustic transducer 800 with another embodiment of a stationary coil processing block 844. Acoustic transducer 800 also has an optional amplifier 801 coupled between the input terminal 802 and divider 854. Amplifier 801 may be a fixed or adjustable amplifier and provides an amplified version of the input audio signal $V_i$ that is coupled to the moving coil signal generation block 810. The amplifier 801 may be used to adjust the magnitude of the moving coil signal $I_m$.

Stationary coil processing block 844 provides a stationary coil control signal at one of a pre-determined number of voltage levels. Each one of the pre-determined voltage levels corresponds to a range of signal levels of the rectified input signal 843. As the magnitude of the input signal 802 varies from lower to higher levels, the stationary coil processing block 844 switches the stationary coil control signal 850 progressively from lower to higher pre-determined voltage levels. Stationary coil current regulator 846 generates stationary coil signal $I_s$ at different fixed level, depending on the magnitude of the stationary coil control signal 850. The magnetic material (not shown in FIG. 8) is magnetized at various fixed levels corresponding to the various fixed levels of the stationary coil signal $I_s$.

Figure 9:
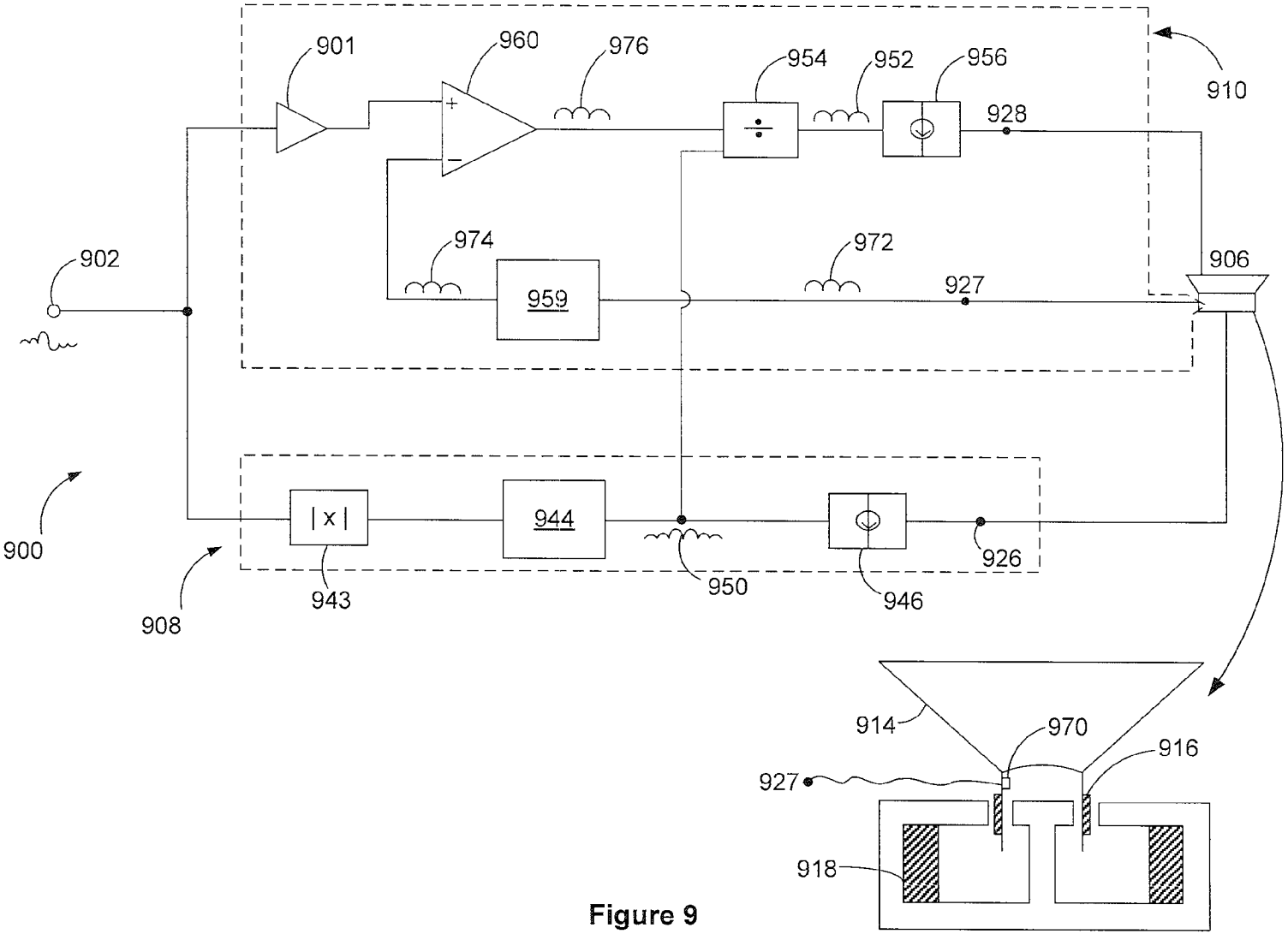

Reference is next made to FIG. 9, which illustrates another acoustic transducer 900 in block diagram form and some parts of driver 906. Moving coil signal generation block 910 includes a compensation network 959, an error amplifier 960 and a sensor 970. Sensor 970 senses a characteristic of driver 906 and provides a sensor signal 972 corresponding to the sensed characteristic. In this embodiment, the sensor is an accelerometer, which is mounted on the moving coil former 916. The accelerometer provides a coil movement signal corresponding to the movement of the moving coil former (and the diaphragm 914) at a sensor terminal 927. The coil movement signal, or more generally, the sensor signal 972 is coupled to compensation network 959, which provides a compensated movement signal 974. The compensated movement signal is coupled to the error amplifier 960, which combines the amplified input signal from amplifier 901 and the compensated movement signal to provide a moving coil error signal 976. Divider 954 divides the moving coil error signal 976 by the stationary coil control signal 950 to generate a moving coil control signal 952.

The compensated movement signal corresponds to the sensor signal, but is scaled, filtered, integrated, differentiated, or otherwise adapted by the compensation network to allow it to be combined with the amplified input signal to compensate for an undesired condition in the characteristic sensed by the sensor 970. For example, in the present example where the sensor is an accelerometer, the sensor signal indicates the acceleration of diaphragm 914. The compensation network 959 provides the compensated movement signal to indicate the movement of the diaphragm 914. The movement of the diaphragm is compared to the magnitude of the amplified input signal by error amplifier 960 and the moving coil control signal is adjusted based on the comparison to correct for an inaccuracy in the movement of the diaphragm relative to the movement that is desired based on the magnitude of the amplified input signal.

In other embodiments, different types of sensors may be provided to sense other characteristics of the acoustic transducer. For example, a thermal sensor may provide a signal corresponding to temperature of the stationary coil, the moving coil or another part of transducer. The signal may be used to adjust the stationary or moving coil signals to allow a coil at an undesirably high temperature to cool. In another embodiment, an optical sensor may be used to sense the position of the diaphragm. In other embodiments, other types of sensors may be used. In some embodiments two or more sensors may be provided to sense multiple characteristics and the stationary and moving coil signals may be generated in response to some or all of the characteristics.

Figure 16:
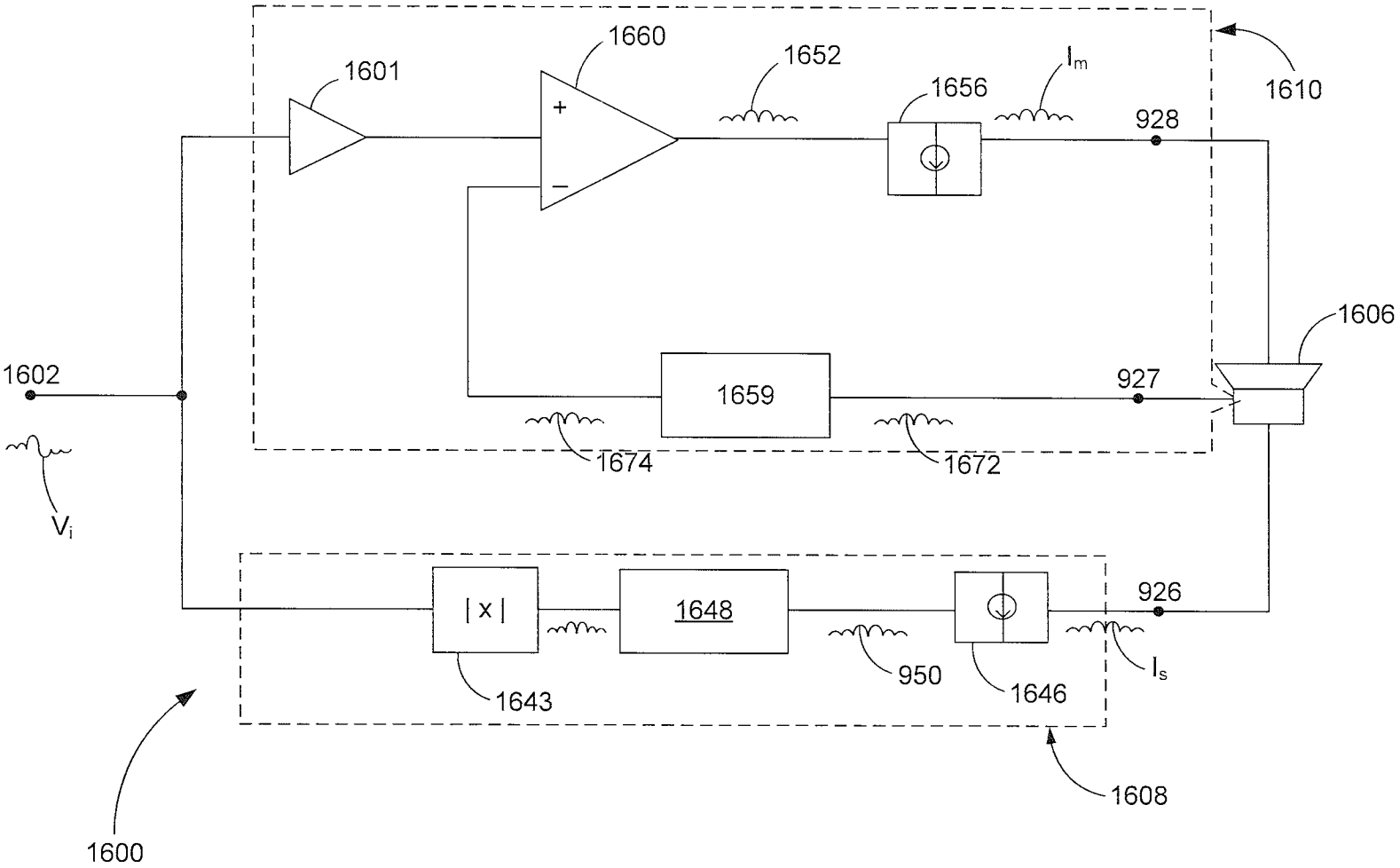

Reference is next made to FIG. 16, which illustrates another embodiment of an acoustic transducer 1600 incorporating feedback from a sensor coupled to the driver. In acoustic transducer 1600, the stationary coil signal generation block 1608 generates the stationary coil signal $I_s$ as described above. The moving coil signal generation block 1610 does not receive any signals directly from the stationary coil signal generation block 1608. Compensation block 1659 generates a compensated movement signal 1674 based on a sensor signal 1672 from a sensor coupled to the driver 1606. The moving coil control signal 1652 is generated by error amplifier 1660. Error amplifier 1660 amplifies the difference between the compensated movement signal and the amplifier input signal from the amplifier 1601 to produce a moving coil control signal 1652 which controls the moving coil. Current regulator 1656 converts the moving coil control signal 1652 into the moving coil signal $I_m$.

In acoustic transducer 900, feedforward from stationary coil control signal 950 is used to modify the moving coil control signal 952 using divider block 954. In some embodiments this division may improve the stability, linearity, or some other aspect of the moving coil control loop. In contrast, acoustic transducer 1600 does not use a divider or any signal and the moving coil control signal is calculated by combining the amplified input signal and the compensated movement signal.

Figure 10:
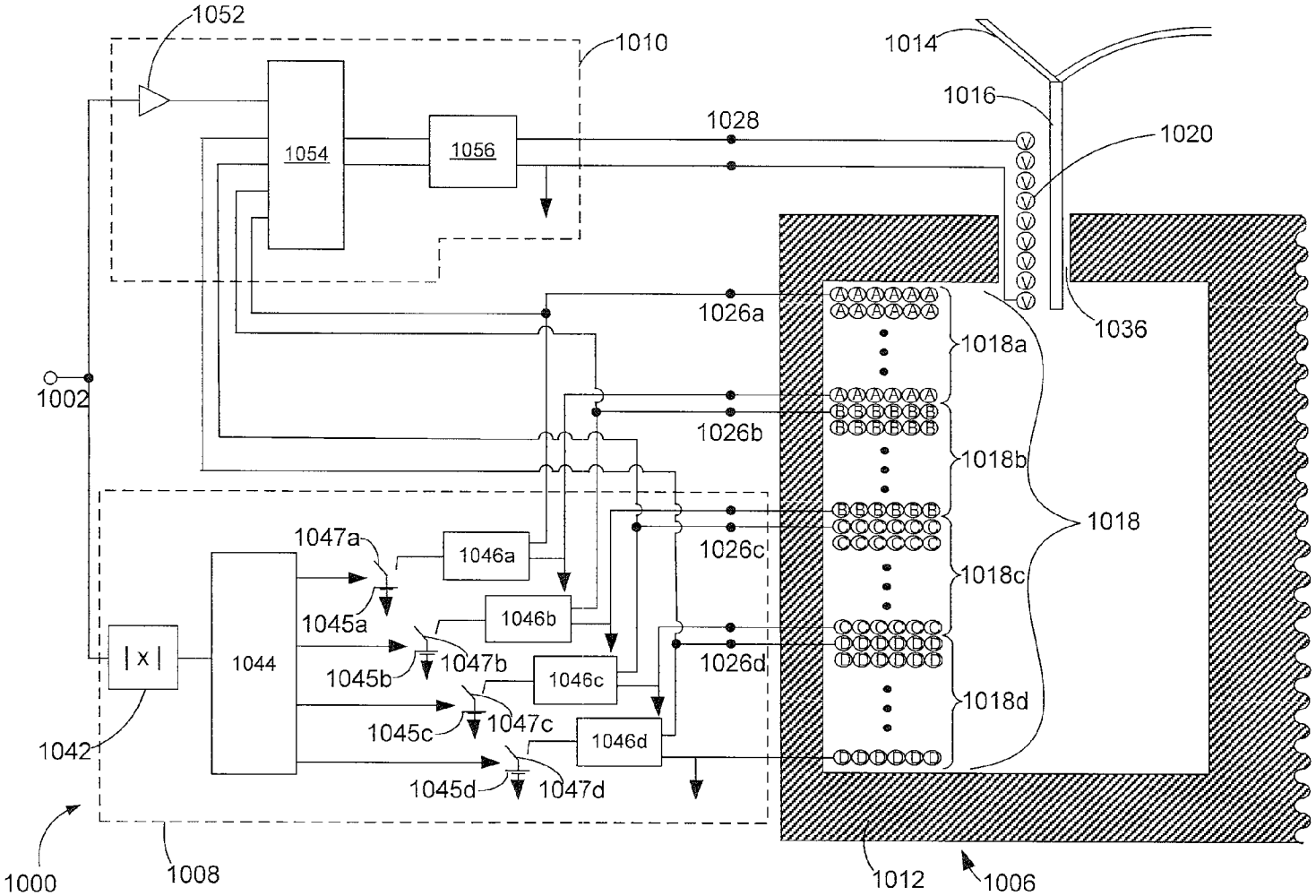

Reference is next made to FIG. 10, which illustrates another embodiment of an acoustic transducer 1000. Acoustic transducer 1000 has an input terminal 1002, a stationary coil signal generation block 1008, a moving coil signal generation block 1010 and driver 1006. Only a portion of driver 1006 is shown. Driver 1006 has a magnetic material 1012 that is capable of being magnetized in the presence of an electrical signal. Driver 1006 has a plurality of stationary coils 1018*a*-1018*d* and a moving coil 1020. Moving coil 1020 is mounted on a moving coil former 1016. Moving coil former 1016 is coupled to a diaphragm, which is shown only in part.

Stationary coil signal generation block 1008 has a stationary coil processing block 1044, a plurality of voltage sources 1045*a*-1045*d*, switches 1047*a*-1047*d* and current regulators 1046*a*-1046*d*. Stationary coil processing block 1044 is coupled to each of the switches 1047*a*-1047*d*. Stationary coil processing block 1044 generates a plurality of stationary coil control signals, one for each switch 1047*a*, 1047*b*, 1047 or 1047*d*. When a stationary coil control signal is high, the corresponding switch 1047*a*, 1047*b*, 1047 or 1047*d* is closed and the corresponding voltage source 1045*a*, 1045*b*, 1045*c* or 1045*d* is coupled to its corresponding current regulator 1046*a*, 1046*b*, 1046*c* or 1046*d*. The current regulator provides a current signal $I_s$ at corresponding node 1026*a*, 1026*b*, 1026*c* or 1026*d* that energizes the corresponding stationary coil 1018, thereby magnetizing the generally toroidal magnetic material 1012.

In this embodiment, each of the stationary coils 1018*a*-1018*d* has the same number of turns within the magnetic material 1012 and is made of the same material. Stationary coil processing block 1044 may energize one, two, three or all four of the stationary coils 1018, thereby controlling the amount of magnetic flux produced in the magnetic material and in air gap 1036. In this embodiment, stationary coil processing block 1044 energize one or more of the stationary coils depending on the magnitude of the rectified input signal provided by rectifier 1042. For example, a series of three threshold magnitudes may be selected. When the magnitude of the rectified input signal is below all of the threshold magnitudes, only one of the stationary coils may be energized. When the magnitude of the rectified input signal is greater than the lowest threshold magnitude, then two of the stationary coils are energized. When the magnitude of the rectified input signal is greater than two of the threshold magnitudes, then three of the stationary coils are energized. When the magnitude of the rectified input signal exceeds all three of the threshold magnitudes, then all four of the stationary coils are energized.

Each of the stationary coil control signals is coupled to a moving coil processing block 1054. Moving coil processing block 1054 generates a moving coil control signal based on the scaled input signal from scaler 1052, and the stationary coil control signals. For example, the moving coil processing block 1054 may divide the scaled input signal by the sum of the stationary coil control signals. The moving coil control signal is coupled to a current regulator 1056, which generates a corresponding moving coil signal $I_m$, which is coupled to moving coil 1020. Moving coil 1020 moves within air gap 1036 in response to the moving coil signal and the magnetic flux in the air gap. Diaphragm 1014 moves with moving coil 1020 and generates sound.

In audio transducer 1000, there are four stationary coils and each of the stationary coils is made of the same material and has the same number of turns. In other embodiments there may be any number of stationary coils and the stationary coils may be made of different materials or may have a different number of turns or both.

In audio transducer 1000, at least one of the four stationary coils is energized during operation. In this embodiment, the stationary coil signals are unidirectional—they have a signal polarity that does not change in operation. Once the magnetic material 1012 has been magnetized by one or more stationary coil signals in the stationary coils, it will typically have a remanent magnetization until a sufficient stationary coil signal having an opposite polarity is applied to it. In some embodiments, the stationary coil signal generation block may be adapted to switch off the stationary coil signals to all of the stationary coil signals when the rectified input signal is below a threshold. In such an embodiment, the remanent magnetization of the magnetic material may be used in conjunction with a moving coil signal to move the diaphragm 114. The remanent magnetization of the magnetic material may vary depending the stationary coil signal or signals applied to it. In some embodiments, the remanent magnetization of the magnetic material may be measured or modeled and the actual or estimated remanent magnetization may be used to determine the moving coil signal.

In acoustic transducers 1000 (FIG. 10) and 1100 (FIG. 11), each of the stationary coils is energized or de-energized by a corresponding stationary coil signal $I_s$ that is either on or off. In other embodiments, some or all of the stationary coil signal $I_s$ may be produced as time varying signals allowing the magnetic flux in the air gap to be controlled more precisely rather than only stepping between different flux levels.

Figure 11:
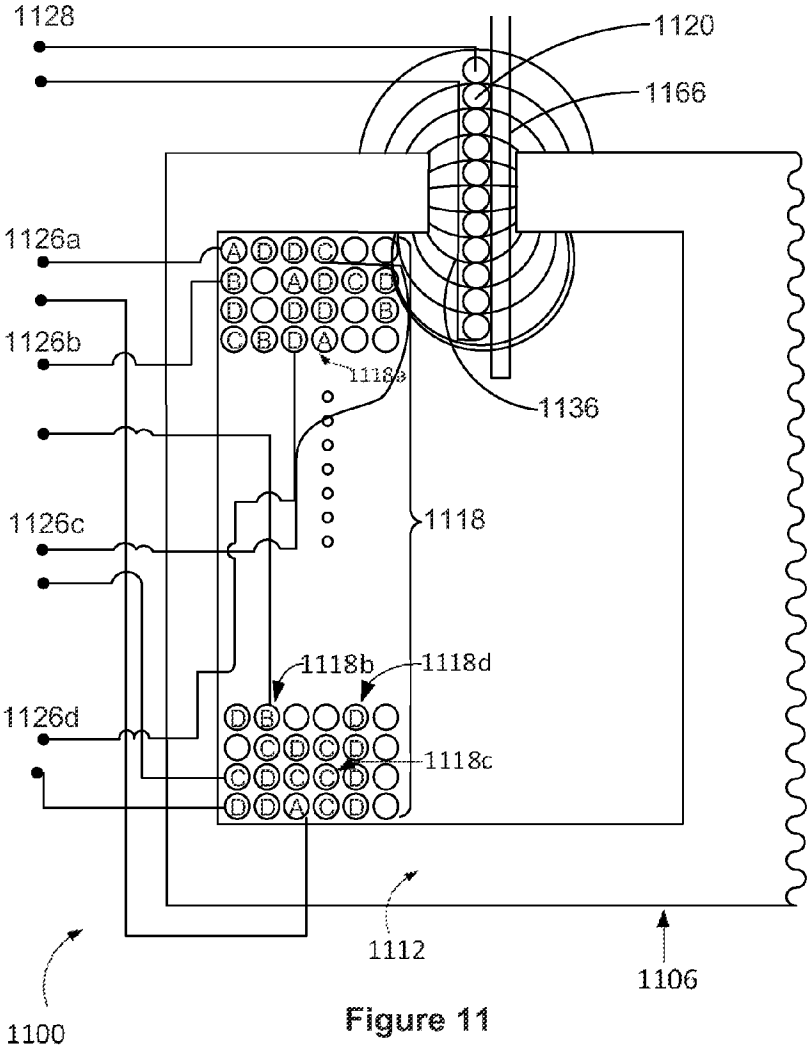

Reference is next made to FIG. 11, which illustrates a driver 1106 that is part of an acoustic transducer 1100. Driver 1106 has four stationary coils 1118*a*-1118*d*. Acoustic transducer 1100 has a similar construction to that of the acoustic transducer 1000, although the stationary coil signal generation block (not shown) may be adapted to power the stationary coils 1118*a*-*d* differently.

The stationary coils are not wound apart from one another as in driver 1006 (FIG. 10), but are interwoven with one another. Each of the stationary coils is made from the same material, but has a different number of windings. For example, winding 1118*a* may have n turns, winding 1118*b* may have 2n turns, winding 1118*c* may have 4n turns and winding 1118*d* may have 8n turns. A stationary coil process block 1144 (not shown) is coupled to the windings 1118 in the same manner as in acoustic transducer 1000. The stationary coil process block 1144 is adapted to switch on and off different combinations of stationary coils. With the combination of four stationary coils 1118*a*-1118*d*, a range of sixteen different levels of magnetic flux may be generated in the magnetic material 1112 and the air gap 1136. In acoustic transducer 1100, a moving coil processing block (not shown) is adapted to generate a moving coil signal in response to the combination of stationary coils signals $I_s$ at nodes 1126*a*, 1126*b*, 1126*c* or 1126*d*.

Figure 12:
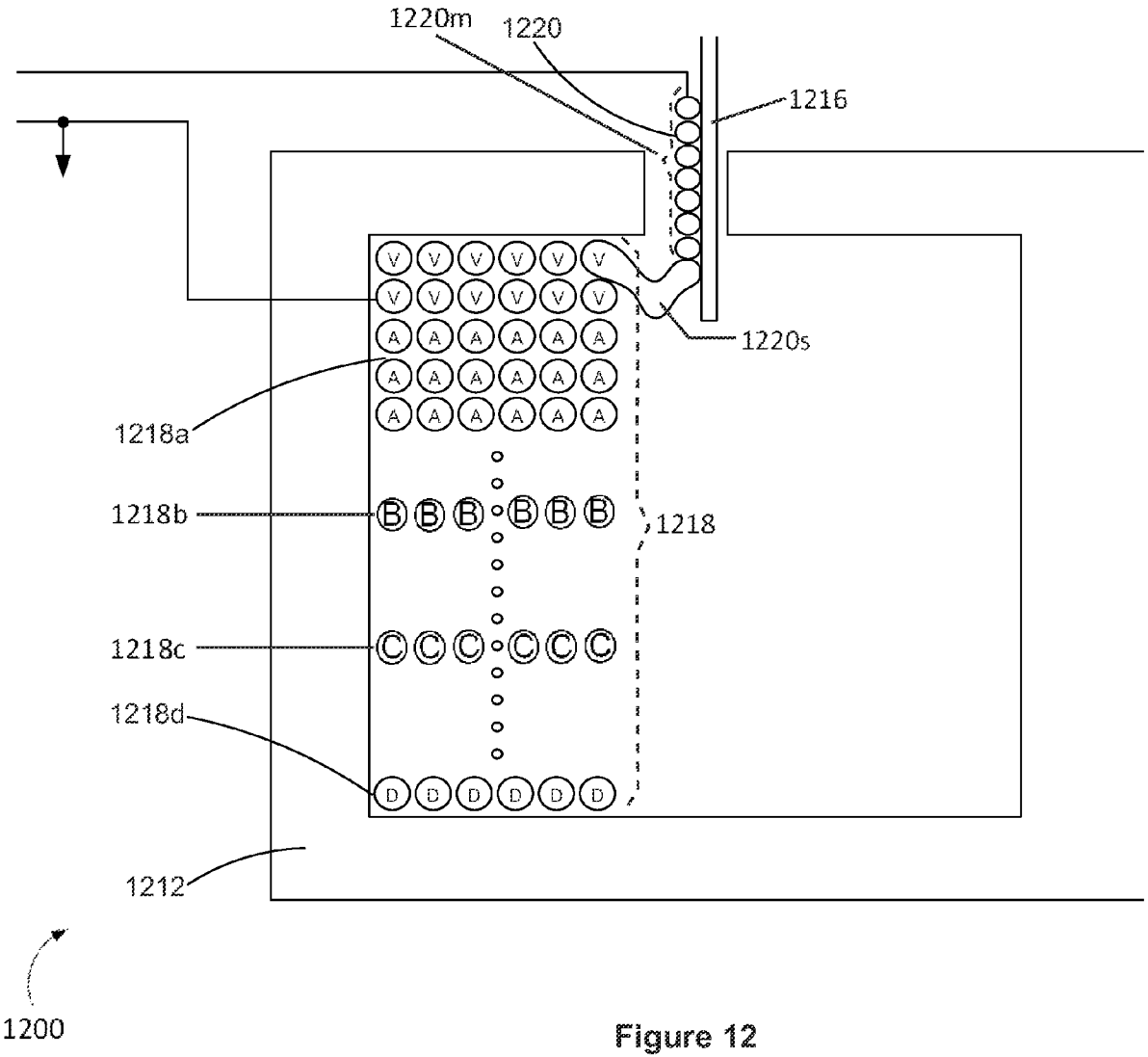

Reference is next made to FIG. 12, which illustrates another acoustic transducer 1200 according to the present invention. In acoustic transducer 1200, four stationary coils 1218*a*-1218*d* are wound in magnetic material 1212. The moving coil 1220 is mounted on moving coil former 1216. The moving coil 1220 continues within the magnetic material 1212 as a stationary bucking coil 1220*s*. Coil 1220*s* is wound in the opposite direction of coil 1220*m*, which is the part of the moving coil 1220 not continuing within the magnetic material 1212. A voltage may be induced in the stationary coils 1218 by the voltage applied to the moving coil not continuing within the magnetic material 1220*m*. By coupling the bucking coil 1220*s* in series with the moving coil not continuing within the magnetic material 1220*m*, but with an opposing polarity, the induced voltage in the stationary coil 1218 is reduced. In another embodiment, bucking coil and the moving coil may be wound separately from one another and then may be connected in series to form a single continuous circuit.

A bucking coil in series with the moving coil but wound with the opposite polarity may be used in any embodiment of an acoustic transducer according to the present invention. The bucking coil is preferably mounted in the driver at a location spaced apart from the moving coil so that the movement of the moving coil former and the diaphragm is not substantially attenuated by the addition of the bucking coil.

In acoustic transducer 1100, the moving coil is longer than the air gap 1136 with the result that as the moving coil moves within the air gap, a portion of the moving coil is within the air gap a greater proportion of time during operation of the acoustic transducer 1100. Magnetic flux in the magnetic material 1112 will remain largely within the physical extent of the magnetic material. The magnetic flux in the area of the air gap will extend beyond the physical extent of the air gap 1136. By extending the moving coil beyond the length of the air gap, a greater portion of the magnetic flux passes through the moving coil 1120. A moving coil that is longer than the air gap may be called an overhung coil.

Figure 13:
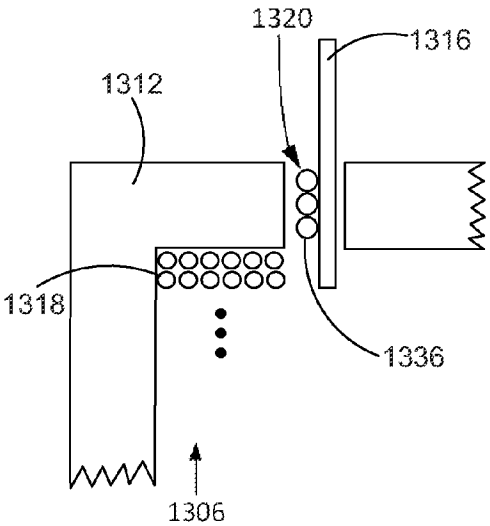

Reference is next made to FIG. 13, which illustrates a driver 1306 with an underhung coil 1320, which is shorter than the air gap 1336. As the moving coil former 1316 and the moving coil 1320 move within and beyond the air gap, the density of the magnetic flux acting on the moving coil remains more constant. In contrast, a longer moving coil, such as the overhung moving coil 1120 of acoustic transducer 1100 (FIG. 11), is more likely to move, at least partially, into a range of weak magnetic flux as it moves beyond the air gap 1136.

Figure 14:
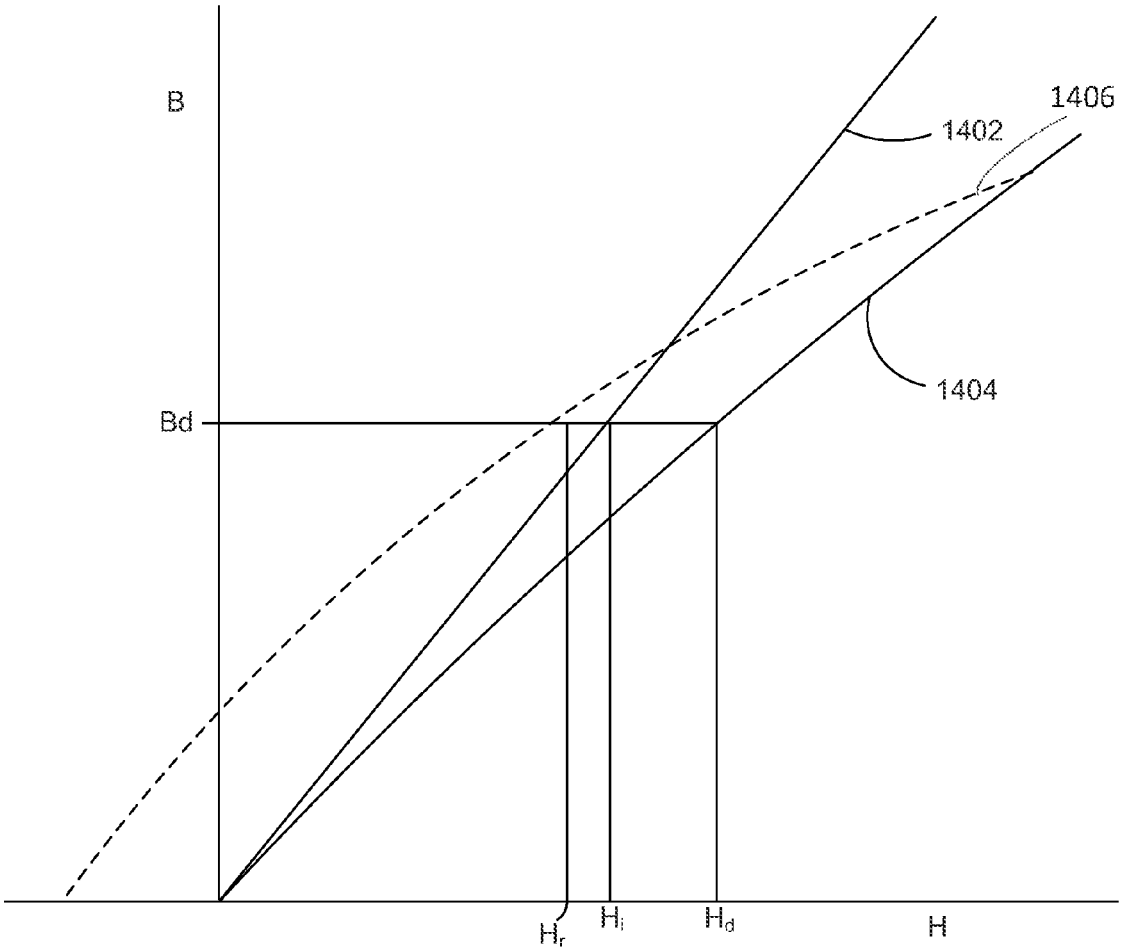
FIG. 14 illustrates some magnetic characteristics of the embodiment of FIG. 15.

Equation (3) above represents an ideal condition in which the BH curve of a magnetic material is linear. Reference is next made to FIG. 14, which illustrates a typical magnetization curve for a magnetic material. The magnetization curve plots the flux density B in the magnetic material versus the field intensity H created by the stationary coil signal $I_s$. An ideal linear relationship is shown at 1402. Magnetic materials exhibit saturation, resulting in a progressive reduction in the marginal magnetic flux density increase in response to progressively larger applied field intensities. The magnetization curve for a typical magnetic material is shown at 1404. If a particular flux density $B_d$ is desired in the magnetic material (or in the air gap), then, in ideal conditions, a field intensity of $H_i$ would be required. However, due to saturation, a field intensity $H_d$ must be achieved to generate the required flux density $B_d$.

Figure 15:
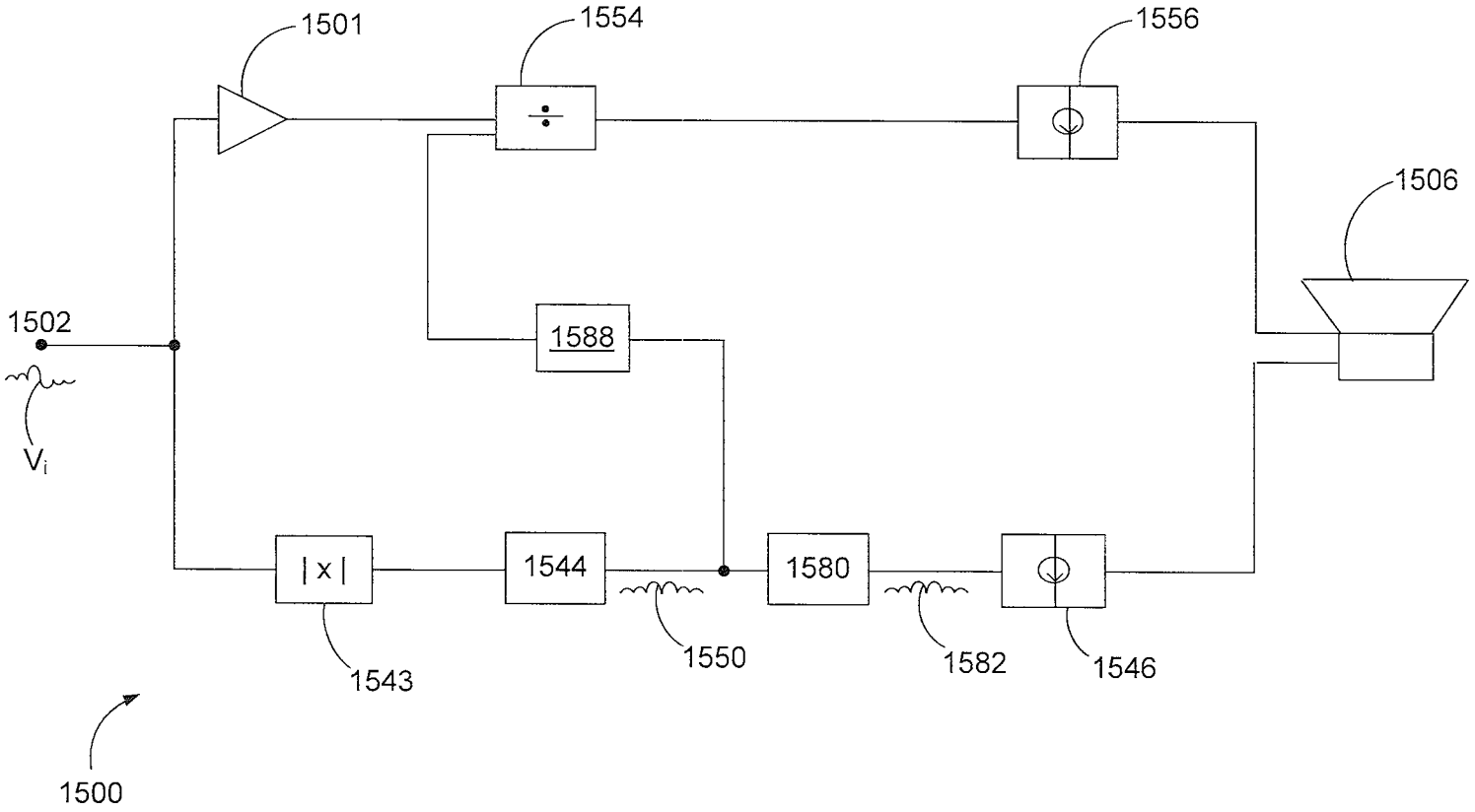

Reference is next made to FIG. 15, which illustrates an embodiment of an acoustic transducer 1500 in which the saturation characteristic of the magnetic material can be at least partially compensated. Acoustic transducer 1500 has a compensation block 1580 coupled between stationary coil processing block 1544 and current regulator 1546. Compensation block 1580 receives the stationary coil control signal 1550 from stationary coil processing block and adjusts it to provide a compensated stationary coil control signal 1582.

In this embodiment, stationary coil processing block 1544 has the same structure and operation as stationary coil processing block 444 of acoustic transducer (FIG. 4). Stationary coil processing block 1544 provides the stationary coil control signal 1550 corresponding to the square root of the rectified input signal. Compensation block 1580 includes a lookup table that sets out an amplification factor for different magnitudes of the stationary coil control signal 1550. Referring to FIG. 14, each magnitude of the stationary coil control signal corresponds to a desired flux density $B_d$. The amplification factor for each magnitude of the stationary coil control signal corresponds to the value of $$\sqrt{\frac{H_d}{H_i}}$$

for the corresponding desired flux density $B_d$. In an embodiment in which a lookup table is used, the possible range of magnitudes of the rectified input signal may be divided into a number of smaller ranges and an amplification factor may be set for each range. In other embodiments, a formula may be used to calculate the amplification factors. In other embodiments, the compensation factor may be calculated using feedback from a sensor in the driver 1506.

Referring again to FIG. 15, the compensation block provides the compensated stationary coil control signal 1582 by multiplying the stationary coil control signal 1550 by the amplification factor set out in the look-up table.

The compensated stationary coil control signal 1582 is coupled to a current regulator 1546, which provides the stationary coil signal $I_s$ as a current signal.

The stationary coil control signal 1550 is also coupled to a coil loss balancing block 1588. The present embodiment is adapted to reduce the total losses in the stationary and moving coils. The coil loss compensation block 1588 includes a lookup table the sets out a loss compensation factor for each value magnitude of the stationary coil control signal. The loss compensation factor for each magnitude of the stationary coil control signal 1550 corresponds to the value of $$\left(\sqrt{\frac{H_d}{H_i}}\right)^{-1},$$

which is the inverse of the amplification factor applied by the compensation block 1580. The coil loss balancing block 1588 multiplies the stationary coil control signal 1550 by the loss compensation factor to provide a loss compensated stationary coil control signal. Divider 1554 divides the input signal (or an amplified version of the input signal if an amplifier is coupled between the input terminal and the divider 1554) by the loss compensated stationary coil control signal to provide a moving coil control signal. The moving coil control signal is converted into a moving coil signal $I_m$.

In other embodiments, the loss compensation factor may be calculated using a formula, by obtaining the amplification factor used by the compensation block 1580 and inverting it or by another method.

Referring to FIG. 14, the compensation factor implemented by the compensation block 1580 will be greater than 1. The coil loss compensation factor implemented by the coil loss balancing block 1588 is less than one. As a result, both the stationary coil signal $I_s$ and the moving coil signal $I_m$ are increased in a balanced manner to compensate for saturation of the magnetic material.

In some embodiments, there may be no desire to reduce or balance losses in the stationary and moving coils. In such embodiments, the compensation block may implement and compensation factor of $$\frac{H_d}{H_i}$$

and the stationary coil control signal 1550 may be coupled directly to the divider 1554. In other embodiments, the compensation block 1580 and the coil loss balancing block 1588 may implement other amplification factors.

In the various embodiments described above, the magnetic material is magnetized using the stationary coils. In other embodiments of the invention, the acoustic transducer may be a hybrid acoustic transducer that uses both a permanent magnet and one or more stationary coils to magnetize the magnetic material.

In the acoustic transducers described above, the stationary coil (or coils) is (or are) energized with a unidirectional signal $I_s$ and the moving coil is energized with a bidirectional signal $I_m$. In other embodiments, the moving coil may be energized with a unidirectional signal and the stationary coil (or coils) may be energized with a bidirectional signal.

The acoustic transducers described above have a single moving coil, although in some embodiments the moving coil is coupled with an oppositely wound stationary bucking coil. In other embodiments, two or more moving coils may be mounted on the moving coil former. Separate moving coil signals may be coupled to the moving coils, allowing them to be individually controlled and allowing the range of motion of the diaphragm to be varied.

Reference is again made to FIG. 14. As described above, the magnetic material in an embodiments will retain some remanent magnetization once it has been magnetized by a stationary coil signal $I_s$. The magnetic flux density in the magnetic material compared to field intensity, taking into account the remanent magnetization of the magnetic material is shown at 1406. In some embodiments, a compensation block may be adapted to provide a compensated rectified input signal based on the remanent magnetization. For example, if a flux density of $B_d$ is desired in the magnetic material, the compensation block may apply an amplification factor of $$\frac{H_r}{H_i}$$

to the rectified input signal to calculate the compensated rectified input signal. This will reduce the magnitude of the stationary coil signal or signals based on the magnitude of the remanent magnetization of the magnetic material.

The various embodiments described above are described at a block diagram level and with the use of some discrete elements to illustrate the embodiments. Embodiments of the invention, including those described above, may be implemented in a digital signal process device.

The present invention has been described here by way of example only. Various modification and variations may be made to these exemplary embodiments without departing from the spirit and scope of the invention, which is limited only by the appended claims. In particular, various elements, such as the bucking coil of acoustic driver 1100, the underhung and overhung moving coils in various embodiments, the compensation block of acoustic transducer 1500 and other various features of the various embodiments may be combined together and used with different embodiments within the scope of the invention.

We claim:

1. An acoustic transducer comprising:

an audio input terminal for receiving an input audio signal;

one or more stationary coils for inducing a magnetic flux path;

one or more moving coils coupled to a moving diaphragm, wherein the one or more moving coils are disposed at least partially within the magnetic flux path;

a control system coupled to the input terminal and adapted to produce a time-varying stationary coil signal in at least one of the stationary coils and to produce a time-varying moving coil signal in each of the one or more moving coils, and wherein all of the stationary coil signals and the moving coil signals are dependent on the input audio signal, wherein the movement of the diaphragm is in response to the stationary coil signals and the moving coil signal, and wherein the control system includes:

a stationary coil signal generation block to generate one or more stationary coil control signals corresponding to the input audio signal;

one or more stationary coil current regulators to generate the stationary coil signals corresponding to the stationary coil control signals;

a moving coil signal block to generate one or more moving coil control signals corresponding to the input audio signal; and one or more moving coil current regulators to generate the moving coil signals corresponding to the moving coil control signals.

2. The acoustic transducer of claim 1, further including a magnetic material that has an air gap, and wherein the magnetic flux path flows within the magnetic material through the air gap.

3. The acoustic transducer of claim 2, wherein at least one of the moving coils is disposed in the air gap.

4. The acoustic transducer of claim 1, further including a bucking coil in series with at least one selected moving coil and wound with a polarity opposing the polarity of the at least one selected moving coil.

5. The acoustic transducer of claim 1, further including a bucking coil mounted to a stationary component of the acoustic transducer.

6. The acoustic transducer of claim 1, wherein the stationary coil signals are unidirectional causing magnetic flux to flow in the magnetic flux path in a single direction, and wherein the moving coil signals are bidirectional.

7. The acoustic transducer of claim 1, wherein the stationary coil signals are bidirectional and wherein the moving coil signals are bidirectional.

8. The acoustic transducer of claim 1, further including a rectifier coupled to the audio input terminal for providing a rectified audio signal corresponding to the input audio signal and wherein the stationary coil signal generation block is coupled to the rectifier and adapted to generate at least one of the stationary coil signals corresponding to rectified input signal.

9. The acoustic transducer of claim 1, further including a rectifier coupled to the audio input terminal for providing a rectified audio signal corresponding to the input audio signal and wherein the stationary coil signal generation block is coupled to rectifier and adapted to generate at least one of the stationary coil signals corresponding to a square root of the rectified audio signal.

10. The acoustic transducer of claim 9, wherein the moving coil signal block is adapted to generate the moving coil control signal corresponding to the square root of the input audio signal.

11. The acoustic transducer of claim 1, wherein the moving coil signal block is coupled to the stationary coil signal generation block and wherein the moving coil signal block is adapted to generate at least one of the moving coil control signals in response to the input audio signal and at least one of the stationary coil control signals.

12. The acoustic transducer of claim 1, wherein the stationary coil signal generation block is coupled to the moving coil signal block and wherein the stationary coil signal generation block is adapted to generate at least one of the stationary coil signals in response to the input audio signal and at least one of the moving coil signals.

13. The acoustic transducer of claim 1, wherein the control system includes a stationary coil signal generation block to generate the stationary coil signals and wherein the stationary coil signals are generated as digital signals and wherein each of the stationary coil signals energizes a corresponding stationary coil at a fixed level when the stationary coil signal is high.

14. The acoustic transducer of claim 1, including at least two stationary coils and wherein each of the stationary coil signals is a digital signal that selectively energizes a corresponding stationary coil.

15. The acoustic transducer of claim 14, wherein each of the coils applies a different magnetic field to a magnetic material in response to a corresponding stationary coil signal.

16. The acoustic transducer of claim 1, wherein the stationary coil signal generation block includes a compensation block adapted to adjust the stationary coil signal.

17. The acoustic transducer of claim 1, wherein the stationary coil signal generation block includes a compensation block adapted to adjust the stationary coil signal based on a saturation characteristic.

18. The acoustic transducer of claim 17, further including a coil loss compensation block adapted to adjust the moving coil signal based on the saturation characteristic.

19. The acoustic transducer of claim 1, wherein one of:

the moving coil signal, and
the stationary coil signals,
corresponds to the other one of:
the moving coil signal, and
the stationary coil signals.

* * * * *